US005758902A

United States Patent [19]

McManus

[11] Patent Number: 5,758,902

[45] Date of Patent: Jun. 2, 1998

[54] COMBINATION CLIP FOR WRITING BOARD

[76] Inventor: Edward V. McManus, P.O. Box 1942, Paducah, Ky. 42002-1942

[21] Appl. No.: 792,983

[22] Filed: Feb. 3, 1997

[51] Int. Cl.[6] ..... B42D 3/00

[52] U.S. Cl. ..... 281/45; 281/21.1; 281/44; 285/2

[58] Field of Search ..... 281/15.1, 21.1, 281/28, 42, 45, 51; 283/2

[56] References Cited

U.S. PATENT DOCUMENTS

| | | | |
|---|---|---|---|
| D. 203,635 | 2/1966 | Vernon, Sr. | D74/5 |
| D. 204,337 | 4/1966 | Smith | D74/2 |
| D. 351,414 | 10/1994 | Buhner | D19/20 |
| 1,215,643 | 2/1917 | Fuller | 281/45 |
| 2,417,935 | 3/1947 | Kiser | 281/45 |
| 4,136,473 | 1/1979 | Coe | 40/518 |
| 4,173,358 | 11/1979 | Wilson | 281/45 |
| 5,116,012 | 5/1992 | Offenhauer et al. | 281/45 X |
| 5,174,607 | 12/1992 | Hill | 281/45 |
| 5,413,382 | 5/1995 | Cornell et al. | 281/42 X |

*Primary Examiner*—Willmon Fridie, Jr.

*Attorney, Agent, or Firm*—Thomas, Kayden, Horstemeyer & Risley

[57] ABSTRACT

An improved clip for a writing board is provided. In accordance with the invention, the clip includes a clip body attached to a writing board. A clip blade is attached to the clip body and includes a binding edge for releasably binding paper against the writing board. The spring is included and is adapted to urge the binding edge against the writing board. In this manner, paper may be releasably gripped by the binding edge to the writing board. A force receiving release tab is disposed opposite the binding edge of the clip blade for receiving manually-applied force. In response to such force, the release tab urges the binding edge away from the writing board to release the paper. A display holder is attached to the clip blade. The display holder defines a substantially planar display area, and further includes a rolled edge for holding a laminate display sheet adjacent the display area. Finally, at least one identification card holder is attached to the clip for displaying at least one identification card away from the writing board.

21 Claims, 4 Drawing Sheets

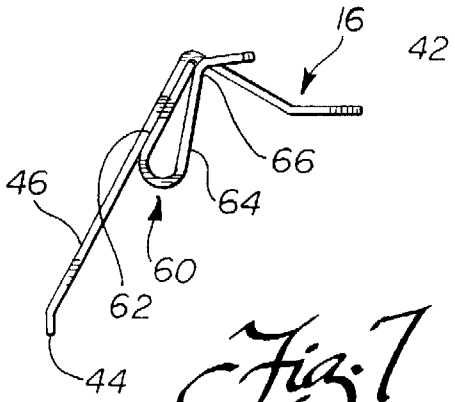
Fig. 7
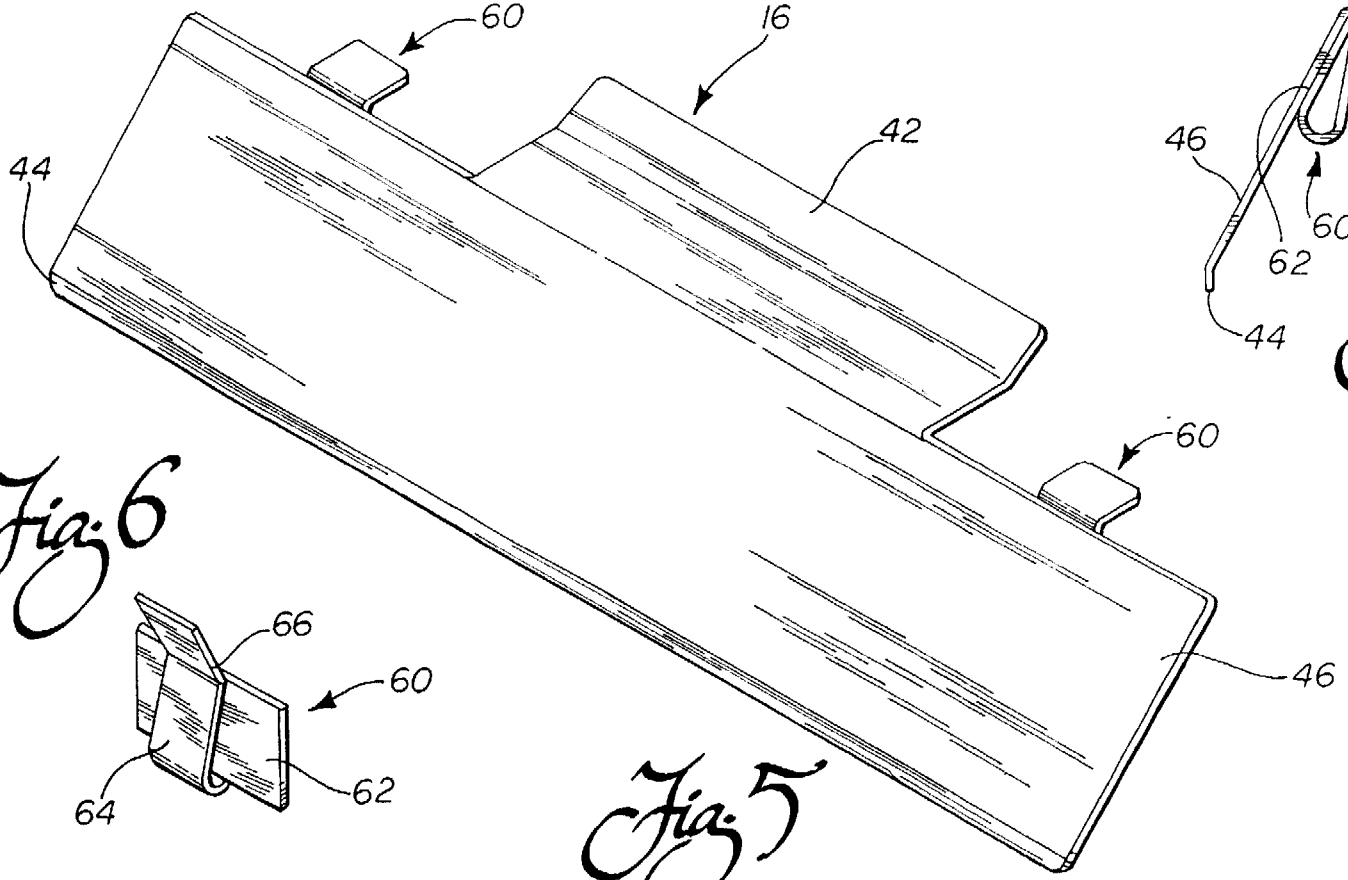
Fig. 5
Fig. 6

COMBINATION CLIP FOR WRITING BOARD

FIELD OF THE INVENTION

The present invention generally relates to clipboard clips, and more particularly to an improved clip for use with a writing board like that used by law enforcement officers for writing citations.

DISCUSSION OF THE RELATED ART

As is known, law enforcement officers typically carry a rectangular box that holds various paraphernalia that an officer may use when filling out a traffic citation, or when obtaining information in the field. As is known, the rectangular box has a top panel that is hinged along one edge and thus openable by rotation about the axis of the hinged edge. When the top panel is in the closed position, it acts like the surface of a clipboard to facilitate the completion of forms or writing information.

Rectangular boxes are known to be assembled with clips having a built-in clock, as well as a calculator. These accessory items are useful to a law-enforcement officer in noting the time to be inserted on a form as well as doing calculations when the need arises. These clips used in combination with the rectangular boxes function well for their specific purpose.

However, there are other circumstances that need to be addressed, as the prior art does not go far enough to satisfy some critical needs of a law enforcement officer. More specifically, it is usually important to have a calendar available in order to accurately supply information regarding court dates (i.e., dates for adjudication of the citation) for violators. It is particularly inconvenient in the later months of the year when required to schedule an event after January 1 of the following year to have to look at two different calendars, one for each year.

Another inconvenience often experienced by law enforcement officers relates to the location to place and hold identification cards while writing down the necessary information on a citation or information form. Most often, two identification cards are requested from an individual, which are placed under the flange or binding edge of the clip and held against the top panel of the rectangular box, which necessarily blocks a portion of the form that is being completed.

There is thus identified a need to improve the handling of identification cards when used by law enforcement officers to complete forms and obtain information. There is also a need for greater convenience in allowing law enforcement personnel to pinpoint future dates for hearings, particularly when transitioning from one year to the next. It is contemplated that improvements made in clips associated with the rectangular boxes may be made to address these problems.

SUMMARY OF THE INVENTION

Accordingly, a primary object of the present invention is to provide a combination clip that overcomes the overcomes the problems of the prior art.

A more specific object of the present invention is to provide a combination clip that secures a plurality of identification cards in a position that does not interfere with any portion of a citation or information form that is being completed.

Still another object of the present invention is to provide a combination clip for a writing board that displays calendar information.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, the present invention is generally directed to an improved clip for a writing board. In accordance with one aspect of the invention, a writing board, defining a planar writing surface, is provided. A clip is attached at one end of the writing board and is adapted for movement between clipped and released positions. In any of a number of ways, the clip is spring-loaded for biased movement toward the clipped position, thereby forming a paper binding edge that releasably binds a writing paper to the writing surface. A laminate display holder is attached to the clip, the display holder having a substantially planar display area defined between opposing sides that are curved inwardly to trap a laminate display sheet therebetween and juxtaposed with the display area. Finally, at least one identification card holder is provided and disposed to prominently display an identification card, while holding the card in a position away from the writing surface.

In accordance with the preferred embodiment, a monthly calendar is displayed on the laminate display sheet. Preferably, the calendar begins with the month of January of a first year, and extends at least through the month of January of the following year. The identification card holder is preferably a resilient or spring loaded clip that is attached to the main clip and readily releasably engages an identification card.

DESCRIPTION OF THE DRAWINGS

The accompanying drawings incorporated in and forming a part of the specification, illustrate several aspects of the present invention, and together with the description serve to explain the principles of the invention. In the drawings:

FIG. 5 is a perspective view of the combination clip constructed in accordance with the present invention, but without the display holder attached;

FIG. 6 is an elevational view of a identification card holding clip, constructed in accordance with the invention; and FIG. 7 is a side view illustrating one manner of attachment between the identification card holding clip of FIG. 6 and the main clip.

Figure 1:
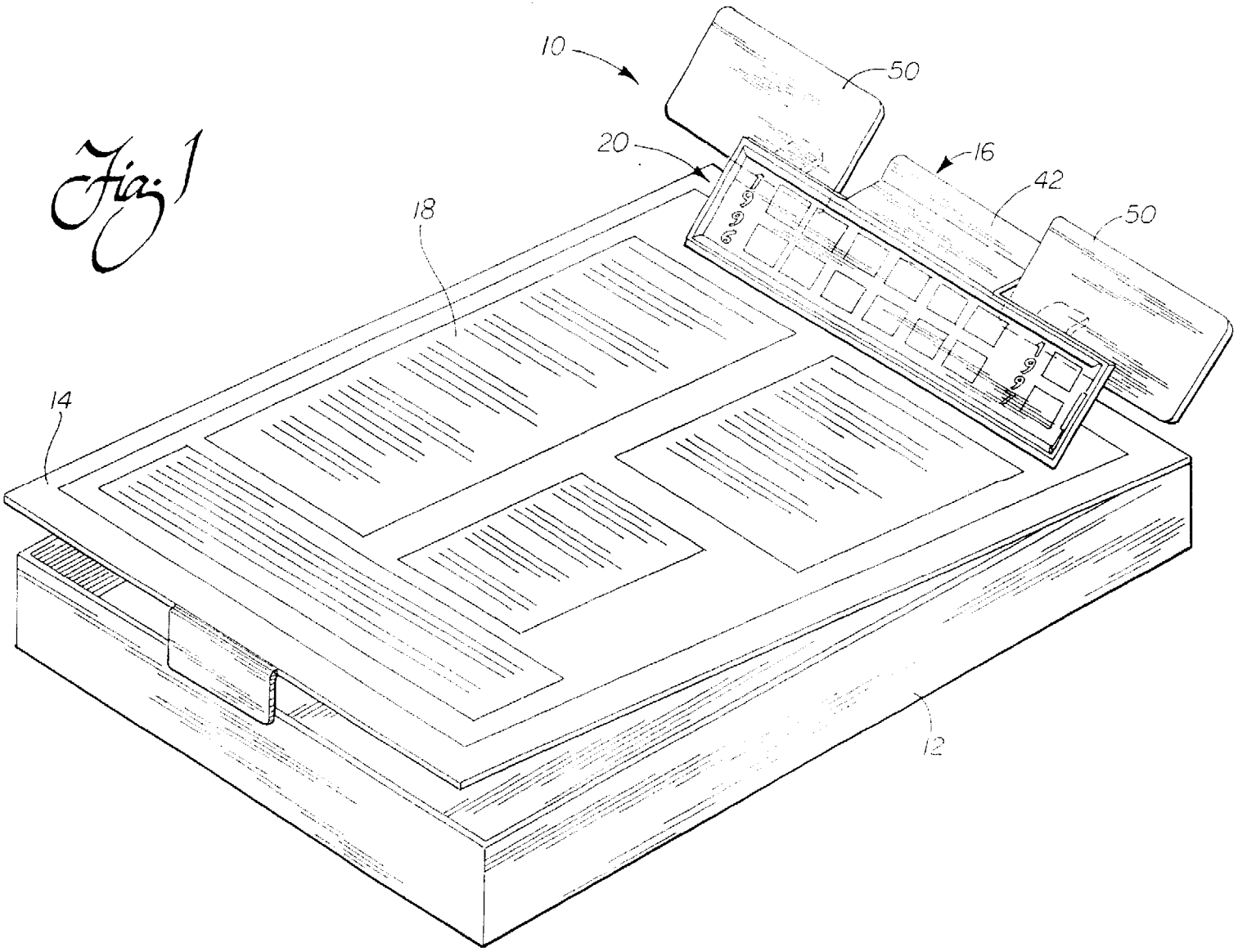
FIG. 1 is a perspective view of a combination display clip/card holder constructed in accordance with the present invention, and utilized in connection with a citation box.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

DETAILED DESCRIPTION OF THE PREFERRED EMBODIMENT

Turning now to the drawings, FIG. 1 shows a perspective view of a combination calendar-display clip/writing board, generally designated by reference numeral 10, constructed in accordance with the present invention. For simplicity in describing the preferred embodiment, the combination calendar-display clip/writing board 10 will be referred to as a citation box 10. The citation box 10, includes a rectangular container 12 for storing preprinted citation forms (of a type use by law enforcement officers), note pads, ink pens, etc. Of course, a variety of other articles may be stored therein as well. Indeed, in alternative embodiments, the citation box 10 of the present invention may be use by people, other than law enforcement officers, such as sales people, wherein the container 12 may store preprinted sales forms. Furthermore, it is noted at the outset that the combination clip of the present invention could be utilized in connection with a well known clipboard, or other planar writing surface, and need not be provided in connection solely with a citation box 10.

A cover 14 is hingedly attached at one end to the container 12, as by piano hinges (not shown) and is adapted for movement between open and closed positions. When in the closed position, the cover 14 overlies the container 12 to secure any contents therein for transport, and also to provide a writing surface. In this respect, the cover 14 may be constructed from aluminum, or alternatively may be constructed of a wood or laminate to provide a better writing surface.

At one end of the cover 14 (the hinged end in the illustrated embodiment), a display clip 16 is provided. Preferably, the display clip 16 is spring-loaded in, for example, the same fashion as a typical clipboard clip, which is well known in the prior art. In this way, the spring-loaded clip 16 urges one edge against the cover 14 (or writing surface) so as to secure a piece of paper, such as a preprinted citation 18, therebetween.

In accordance with one aspect of the invention, the clip 16 includes a display holder 20, for displaying a calendar (also referred to herein as the calendar display, in connection with the preferred embodiment). In accordance with another aspect of the invention, the clip 16 also includes at least one, and preferably two, identification card holding mechanisms. To better illustrate the calendar display 20, reference is made to FIGS. 2, 3, and 4, which illustrate a more detailed view of calendar display 20. Preferably, the calendar display 20 includes a laminate sheet 22, such as plastic, printed with monthly calendars. As is known, when a law enforcement officer issues a citation, a specified court date will typically be included on the citation, so that the person receiving the citation will know when to appear in court. Since the court date will typically be set several weeks in advance, it is important that the law enforcement officer issuing the citation have ready access to calendar information. In accordance with the invention, such calendar information is prominently displayed for viewing.

Figure 2:
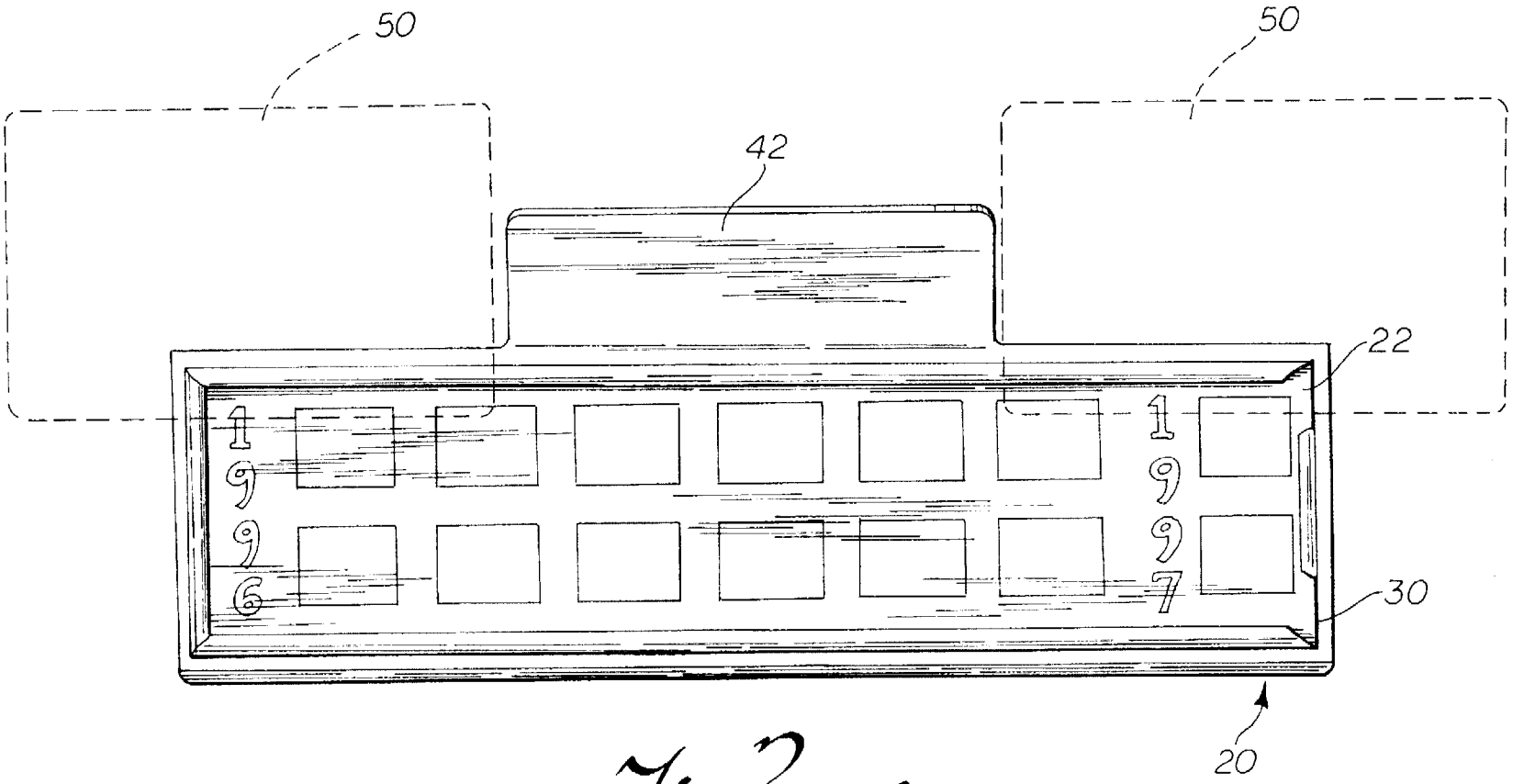
FIG. 2 is an enlarged view of the calendar display illustrated in FIG. 1.

Indeed, one important feature of the preferred embodiment is that the calendar provide more that one year of date information. As illustrated in FIG. 2, the preferred calendar extends from January of a first year, to February of the following year. Once the month of January of the second year is reached, the laminate sheet 22 would be replaced, as described below, with a new calendar sheet. The significance of this feature relates to the issuance of citations during the latter months of a calendar year, such as November and December. During this period, the relevant court dates (i.e., the date for court adjudication of the citation) are often into the following year. Without the year-end overlap feature of the preferred embodiment, the law enforcement officer would be forced to carry a spare calendar for reference during the latter portion of a given year. However, with this year-end overlap feature, calendar information extending into the early portion of the following year is prominently displayed, and thereby provides the desired court-date information.

Figure 3:
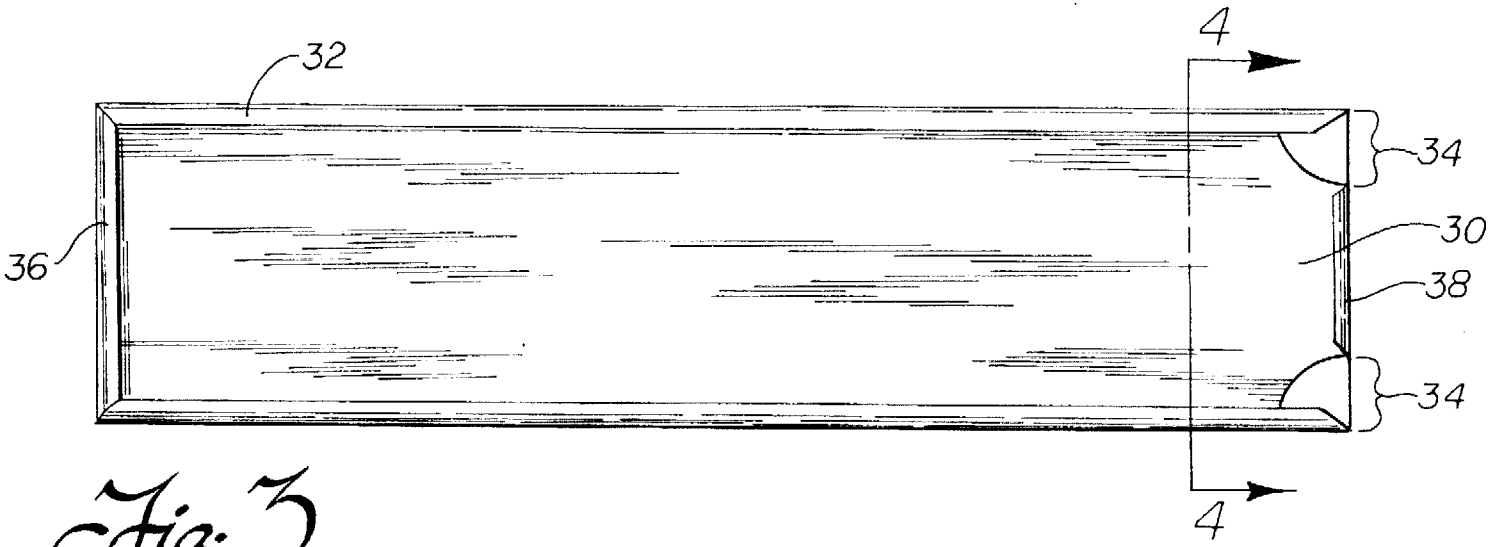
FIG. 3 is a top view of the display holder constructed in accordance with the present invention.
Figure 4:
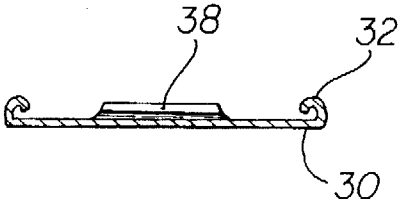
FIG. 4 is a view as taken substantially along line 4—4 of FIG. 3.

Preferably, the laminate calendar sheet 22 is carried in an elongated tray 30 that, in turn, is attached to the movable lip or flange of the clip 16. As best illustrated in FIGS. 3 and 4, this tray 30 is defined by an inwardly rolled edge 32 that traps the laminate calendar sheet 22 therein. Indeed, the rolled edge may be provided to extend substantially about the entire edge, defining a central display area, the rolled edge having only a pair small sectional cutouts 34 near one end (FIG. 3). It is through these cutouts 34 that laminate calendar sheets 22 may be inserted and removed from the tray 30. Specifically, the cutout is large enough that one end of a laminate sheet 22 may be inserted therethrough and slid toward the distal end of the tray 30. Once the end of the laminate sheet 22 is slid under and trapped by the rolled edge 36 of the distal end of the tray 30, then the thin laminate sheet 22 may be flexed so as to permit the proximal end to be inserted at the cutout 34 and slid underneath an inwardly directed retaining tab 38 at the proximal end. In this way, the laminate sheet 22 is securely retained within the tray 30, so as to not inadvertently fall out, but may nevertheless be readily replace with updated calendar displays when appropriate.

Preferably the tray 30 is attached to a front face 46 of the binding clip 16. The particular manner or method for attachment is, however, irrelevant, and is thus not discussed herein. Suffice it to say that the tray 30 may be attached to the clip 16 by welding, riveting, bolting, or any other simple and appropriate means.

In accordance with another feature of the present invention, at least one identification holder 40 is provided. To better illustrate this feature, reference is made to FIGS. 5, 6, and 7. FIG. 5 is a perspective view of only the clip 16 (without the display holder attached). In a manner that is well known, a force-bearing edge or tab 42 is angled from the spring-loaded clip 16. This edge 42 receives force manually applied by a user to raise and lower an opposingly disposed binding edge 44 from the writing board or cover 14. As previously described, the calendar display 20 (not shown in FIG. 5) is attached to the main face 46 of the clip 16. Immediately adjacent the main face 46, near each lateral end of the clip 16, a rectangular region is cut out. The space provided by these cut-out regions 48 allows identification cards 50 (see FIG. 1) to be inserted.

In this regard, at least one identification clip 60 is provided (see FIG. 6). In the preferred embodiment of the present invention, two such identification clips 60 are provided. In their simplest form, the clips 60 may be as illustrated in FIG. 6, having a substantially flat back portion 62, and a curved front portion 64. As better illustrated in FIG. 7, the curved front portion 64, at the innermost point 66, contacts the back portion 62, then flares away from the back portion 62 to define a mouth for receiving an identification card 50. Preferably, the front portion 64 will be so constructed (from any appropriate material, such as aluminum) as to flex away from the back portion 62, in response to the insertion of an identification card, such as a driver's license or credit card. The front portion 64 will, however, have sufficient memory and resilience to snugly grip and retain an identification card 50 therein, yet not so much that the identification card 50 cannot be readily inserted and removed.

In accordance with the preferred embodiment, the back portion 62 is attached to the back side (side opposite the calendar display 20) of the main face 46 of the clip 16. This attachment may be formed by spot welding, riveting, bolting, or any other appropriate means. As illustrated in FIG. 7, the clip 60 is attached so that the identification card receiving end (i.e., mouth) is pointed upwardly to receive an identification card 50. Advantageously, this configuration holds the identification cards 50, when inserted, prominently in view of the law enforcement officer (FIG. 1), while at the same time, keeping the cards 50 away from the face of the writing board and citation form. Recall that in the prior art, identification cards were often clipped between the binding edge 44 of the clip 16 and the writing board, often corrupting the preprinted portion of the citation form.

Consistent with the concepts and teachings of the present invention, other forms of identification card clips could be utilized as well. In one alternative embodiment (not shown), spring-loaded clips, such as those known as alligator clips, could be used. As is known, alligator clips have opposing jaws that are spring-loaded to pivot about a central axis and motivate the jaws to engage at one end (gripping end). Inwardly directed force may be manually applied at the opposite end of the jaws to overcome the spring-loaded force and thereby separate the gripping end of the jaws. Again, one side (or jaw) of the clip could be attached in any suitable way to the main clip 16, so as to prominently display inserted identification cards.

In accordance with yet a further embodiment, the clip 16 may be formed with a groove or recess that would form a press-fit engagement with an identification card 50. In this regard, the calendar display 20 may be attached to the face 46 of the clip 16 is such a way as to provide such a recess.

The foregoing description has been presented for purposes of illustration and description. It is not intended to be exhaustive or to limit the invention to the precise forms disclosed. Obvious modifications or variations are possible in light of the above teachings. For example, the clip and writing board may be integrally formed and of unitary construction. Similarly, the clip may be separately provided for attachment to a writing board.

The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly and legally entitled.

What is claimed is:

1. An improved clip for a writing board comprising:

a writing board defining a planar writing surface;

a clip attached at one end of the writing board, the clip adapted for movement between clipped and released positions, the clip being spring-loaded for biased movement toward the clipped position, the clip having a paper binding edge that releasably binds a writing paper to the writing surface;

a laminate display holder attached to the clip, the display holder having a substantially planar display area defined between opposing sides curved inwardly to trap a laminate display sheet therebetween and juxtaposed with the display area; and at least one identification card holder configured to prominently display an identification card is a position away from the writing surface.

2. The combination clip as defined in claim 1, wherein the clip includes a plurality of identification card holders.

3. The combination clip as defined in claim 2, wherein the clip includes precisely two identification card holders.

4. The combination clip as defined in claim 1, wherein the at least one card holder is formed by a recess disposed along the clip and dimensioned to form a press fit engagement with the at least one identification card.

5. The combination clip as defined in claim 1, wherein the at least one card holder is defined by a resilient card clip attached to the combination clip, the card clip having opposing jaws resiliently disposed to grip an inserted identification card therebetween.

6. The combination clip as defined in claim 1, wherein the at least one card holder is defined by a spring-loaded card clip attached to the combination clip, the card clip having opposing jaws that are spring-loaded to bias together and grip an inserted identification card therebetween.

7. The combination clip as defined in claim 1, wherein the laminate display includes a calendar display.

8. The combination clip as defined in claim 7, wherein the calendar display is a monthly calendar display.

9. The combination clip as defined in claim 7, wherein the laminate display includes a monthly calendar display, the calendar displaying fourteen months beginning with the month of January of a first year and ending with the month of February of the following year.

10. The combination clip as defined in claim 1, wherein the writing board is disposed to overly and cover a storage box.

11. The combination clip as defined in claim 10, wherein the storage box is of the type used by law enforcement officers for storing preprinted citation forms.

12. The combination clip as defined in claim 10, wherein the writing board is hingedly along one edge to the storage box, and is adapted for movement about the hinge between open and closed positions, wherein in the open position access is permitted to a storage area within the storage box, and in the closed position, the storage area is closed.

13. The combination clip as defined in claim 1, wherein the display holder is integrally attached to the clip.

14. An improved clip for a writing board comprising:

a clip body;

means for attaching the clip body to a writing board;

a clip blade attached to the clip body, the clip blade having a binding edge for releasably binding paper against the writing board;

spring means for urging the binding edge against the writing board;

a force receiving release tab opposite the binding edge of the clip blade, the release tab responsive to applied pressure to urge the binding edge away from the writing board to release the paper;

a display holder attached to the clip blade, the display holder defining a display area, and further including means for holding a laminate display sheet adjacent the display area; and at least one identification card holder attached to the clip for displaying at least one identification card away from the writing board.

15. The clip as defined in claim 14, wherein the laminate display sheet includes a monthly calendar, containing at least twelve months of date information.

16. The clip as defined in claim 14, wherein the clip includes two identification card holders, each of which are spring-loaded to releasably grip an inserted identification card.

17. The clip as defined in claim 14, wherein the writing board is disposed to overly and cover a storage box.

18. The clip as defined in claim 17, wherein the storage box is of the type used by law enforcement officers for storing preprinted citation forms.

19. The clip as defined in claim 17, wherein the writing board is hingedly along one edge to the storage box, and is adapted for movement about the hinge between open and closed positions, wherein in the open position access is permitted to a storage area within the storage box, and in the closed position, the storage area is closed.

20. The clip as defined in claim 14, wherein the clip and writing board are integrally formed.

21. The clip as defined in claim 20, wherein the clip is formed from injection molding.

* * * * *